United States Patent [19]

Steele

[11] 4,177,732

[45] Dec. 11, 1979

[54] EXPLOSIVE FUSE-CORD

[75] Inventor: Daniel Steele, Stevenston, Scotland

[73] Assignee: Imperial Chemical Industries Limited, London, England

[21] Appl. No.: 843,057

[22] Filed: Oct. 17, 1977

[30] Foreign Application Priority Data

Nov. 8, 1976 [GB] United Kingdom ..... 46361/76

[51] Int. Cl.[2] ..... C06C 5/04

[52] U.S. Cl. ..... 102/27 R; 86/22

[58] Field of Search ..... 102/27 R; 86/1, 22

[56] References Cited

U.S. PATENT DOCUMENTS

| | | | |
|---|---|---|---|
| 1,023,142 | 4/1912 | Ellsworth | 102/27 R |
| 3,125,024 | 3/1964 | Hicks et al. | 102/27 R |
| 3,155,038 | 11/1964 | Smith | 102/27 R |
| 3,796,126 | 3/1974 | Turner | 102/27 R |
| 3,867,884 | 2/1975 | Langrish-Smith | 102/27 R |
| 3,908,549 | 9/1975 | Turner | 102/27 R |

*Primary Examiner*—Verlin R. Pendegrass
*Attorney, Agent, or Firm*—Cushman, Darby & Cushman

[57] ABSTRACT

An explosive fusecord comprising a core of explosive material surrounded by at least two layers of wrapping material, two adjacent layers being bonded together by an intermediate layer of waterproof hot-melt adhesive material which is preferably a blend of polymeric film former and a tackifying resin. The fusecord is especially useful as an energy source for seismic prospecting .

21 Claims, 2 Drawing Figures

EXPLOSIVE FUSE-CORD

Figure 1:
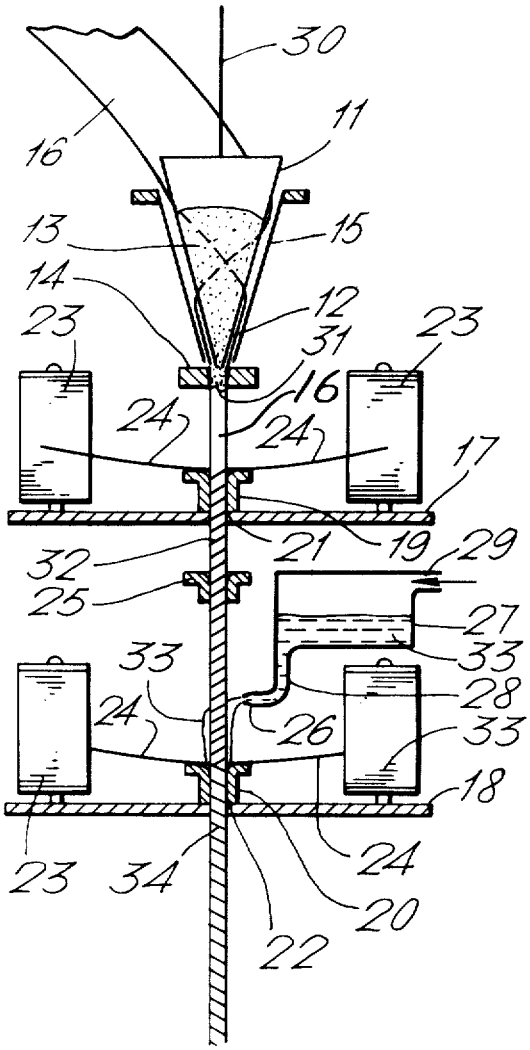

This invention relates to explosive fusecord and to a method of manufacturing explosive fusecord. Such fusecord is used for ignition transmission in blasting operations and includes both detonating and incendiary cords. Detonating cord of the invention is especially advantageous as a seismic energy source and the invention also includes a method of seismic prospectng wherein such detonating cord is used as the seismic energy source.

In one commonly used construction of explosive fusecord a thin core of explosive powder is encased in a thin paper or plastics tube formed by a foil strip overlapped at its edges and the tube is reinforced with wrapping material usually comprising one or more spun layers of textile yarns surrounded by an outer sheath of thermoplastics material. In the manufacture of cords of this construction, the thin tube is continuously formed from tape, usually longitudinal tape, which is convoluted around its longitudinal axis to form the tube by passing it through a die. The explosive is continuously fed from a hopper into the tube as the tube is being formed and is consolidated by passing the tube through dies to form the explosive core. Textile yarns on bobbins rotating around the tube are continuously helically wound around the tube and the outer sheath is extruded around the yarns.

The outer thermoplastics sheath confers additional strength to the fusecord but its main purpose is to waterproof the fusecord. The amount of thermoplastics material in the sheath constitutes a substantial proportion of the total weight and volume of the fusecord and also accounts for a high proportion of the total cost.

It is an object of this invention to provide a wrapped explosive fusecord having adequate strength and water resistance without the need for an external extruded thermoplastics sheath.

In accordance with this invention an explosive fusecord comprises a core of explosive material surrounded by at least two layers of wrapping textile material, two adjacent wrapping layers being bonded together by an intermediate layer of waterproof hot-melt adhesive material.

The hot-melt adhesive is a thermoplastic material which is solid and substantially tack free at room temperature, can be applied to an adherent surface when molten and develops bond strength on subsequent cooling to room temperature. Modern hot-melt adhesives are described in the Encyclopedia of Polymer Science and Technology, Volume 12, Pages 148 and 149.

The preferred hot-melt adhesive comprises a blend of polymeric film former and a resin, a convenient ratio of these ingredients being from 2:1 to 1:2 by weight, and it may optionally contain other modifying ingredients to impart desired properties. The film former is conveniently one based on polyolefin. A copolymer of ethylene and a co-monomer which is an ethylenically unsaturated fatty acid containing from 3 to 8 carbon atoms or an ethylenically unsaturated fatty acid ester containing from 3 to 8 carbon atoms is especially advantageous. Examples of such unsaturated compounds include acrylic acid, methacrylic acid, alkyl esters of acrylic and methacrylic acid, hydroxyethyl methacrylate, vinyl acetate and vinyl propionate. A preferred copolymer is one containing from 7 to 30% by weight of the said comonomer.

The resin is preferably a tackifying resin which improves the adhesiveness of the molten adhesive to the wrapping layers. Suitable resins include, for example, coumarone-indene, terpene and phenolic resins but the preferred resins are those of the rosin family. Particularly useful rosin derivatives are hydrogenated rosin and hydrogenated rosin esterified with, for example, glycerol or pentaerythritol.

The hot-melt adhesive may also contain wax, for example, petroleum wax to enhance its flow properties.

The melting temperature of the hot-melt adhesive should be greater than the temperature which the fusecord is required to withstand in normal use and preferably should not greatly exceed the melting point of the explosive material in the core of the fusecord. Thus for pentaerythritol tetranitrate (PETN) cores the hot-melt adhesive should preferably have an application temperature in the range 80° to 155° C.

The wrapping material conveniently comprises paper, synthetic plastics, cotton or jute. One advantageous material is fibrillated plastics tape, for example, fibrillated polypropylene.

The explosive core material may conveniently comprise blackpowder in the slow-burning safety fusecords and PETN in detonating fusecord. Detonating cords of the invention preferably have a thin foil envelope immediately around the core, which envelope may, if desired, constitute one of the said wrapping layers bonded by the hot-melt adhesive. A central textile yarn may also be included to assist the flow of the explosive material and the formation of the core as in conventional detonating cords.

The invention also includes a method of manufacturing fusecord which comprises continuously forming a fuse core of explosive material, and surrounding said core with at least two layers of wrapping material, which layers are bonded together with a layer of hot-melt adhesive.

In a preferred method of the invention a first layer of filamentary textile material is helically spun around the core, the said first layer is covered with a molten layer of hot-melt adhesive and a second layer of filamentary textile material is helically spun around the layer of molten adhesive, whereby when the adhesive cools the said first and second layers of textile material are bonded together. Preferably the second textile layer is spun counter to the first layer.

The hot-melt adhesive can be applied in any convenient manner. Thus it could be applied to the first wrapping layer as a particulate solid material and melted before the application of the second wrapping layer. It is more convenient, however, to apply the hot-melt adhesive in molten condition to the first wrapping layer and to apply the second wrapping layer around the still molten layer of adhesive. The molten adhesive may, for example, be applied by passing the embryo cord, having only one of the said wrapping layers surrounding the core, through a vessel of molten adhesive, over a hot 'lick' roll coated with molten adhesive or through a spray of molten adhesive. Whatever method is used to apply the hot-melt adhesive, the molten adhesive spreads between the wrapping layers and, on cooling, forms a strong bond between the layers. When the wrapping layers comprise textile filaments, adjacent filaments are also strongly bonded together. The explosive core is thereby surrounded by a strong waterproof protective casing which maintains the core in its original compacted state.

The invention further includes an apparatus for the manufacture of explosive fusecord, which apparatus comprises explosive feed means for delivering a stream of explosive, explosive core forming means for consolidating said stream to form a continuously advancing explosive core, means to apply a layer of wrapping material aroung said core, hot-melt adhesive applicator means to apply a molten layer of hot-melt adhesive around the outside of the said wrapping layer and means to apply a further layer of wrapping material aroung said hot-melt adhesive layer.

In order to illustrate the invention further a preferred fusecord and its manufacture is hereinafter described, by way of example, with reference to the accompanying drawings wherein FIG. 1 is a diagrammatic line diagram showing the apparatus and the fusecord manufacture.

Figure 2:
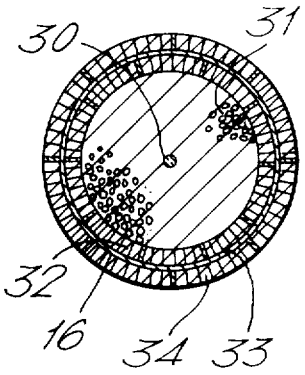

FIG. 2 is a cross-section of the finished fusecord.

The formation of the explosive core of the fusecord from particles of explosive compressed within a thin tubular envelope and the application of reinforcing layers of spun and counter-spun textile filaments around the tubular envelope is carried out in the conventional manner used for fusecord manufacture and described, for example, in United Kingdom Pat. No. 1,120,200. The apparatus includes a funnel 11 with an outlet 12 for holding and delivering powdered explosive material 13 through a die 14 which is axially positioned below outlet 12. A guide funnel 15 surrounds funnel 11, the relative positioning of the funnels 11 and 15 and the die 14 being such that tape 16 drawn longitudinally through the annular space between the funnels 11 and 15 and through the die 14 is convoluted longitudinally to form a tube around explosive material 13 emerging from outlet 12 and passing through the die 14.

Sequentially below the die 14 are two spinning platforms 17 and 18, rotatable in opposite directions for applying respectively a first spun textile layer and a second counterspun textile layer around the first layer. The platforms have central hubs 19 and 20 each hub having a central aperture 21, 22 through which the fusecord passes and is compressed during its manufacture. Each platform is adapted to carry a plurality of freely rotatable bobbins 23 of textile filaments 24 from which filaments are drawn and trained through the apertures 21 and 22 whereby the filaments are helically wrapped around the descending fusecord.

A compression die 25, is located below the hub 19 and a spray nozzle 26 is located between the die 25 and hub 20. An adhesive melting vessel 27 is connected to the nozzle 26 by a heated conduit 28 and the vessel 27 has an air supply inlet 29 whereby the interior of the vessel 27 can be pressurised.

In the manufacture of fusecord in the aforedescribed apparatus a centre transport thread 30 is continuously drawn from a bobbin (not shown), downwardly through the funnel 11, outlet 12, die 14, aperture 21, die 25, and aperture 22. The funnel 11 is partially filled with explosive powder 13 and the moving thread 30 ensures that a constant stream of powder 13 passes through the outlet 12, the funnel 11 being replenished as required. A tape 16 of paper or plastics film is drawn through the space between the funnels 11 and 15, through die 14, where it is convoluted into a tube around the descending stream of explosive powder 13, and subsequently through aperture 21, die 25 and aperture 22. The stream of powder 13 is compressed inside the tubular tape 16 during its passage through die 14 to form a consolidated explosive core 31 for the fusecord.

A thread from each bobbin 23 on platform 17 is drawn through aperture 21 and, as the platform 17 and hub 19 rotate, the several threads are helically wound around the outside of the descending tubular tape 16, to form a continuous textile layer 32. The descending fusecord subsequently passes through the die 25, where the explosive powder 13 is further consolidated and crushed, and then passes the jet nozzle 26. Hot-melt adhesive 33 is melted in vessel 27, the vessel is pressurised with compressed air and the molten adhesive is forced through nozzle 26 to form a continuous layer of adhesive 33 around the textile layer 32. Although only one nozzle outlet 26 is shown in FIG. 1, there will normally be two or three nozzle outlets distributed around the path of the descending fusecord. A second textile layer 34 is applied over the still molten adhesive 33 in a direction counter to the layer 32 by drawing a thread from each bobbin on platform 18 through aperture 22 as the platform 18 is rotated in a direction counter to that of platform 17. The adhesive layer 32 impregnates the textile layers 32 and 34 and solidifies rapidly to form a bond between adjacent filaments in each layer and between the two layers. The layer 32 is also bonded to the tubular tape 16.

The detonating cord produced by this method is sufficiently strong and waterproof for most commercial uses and it is eminently suitable for use as a seismic wave generator in the seismic prospecting method described in United Kingdom Pat. Nos. 1,151,882 and 1,151,883 wherein a line of detonating cord is buried by feeding it down through a conduit into the ground as the conduit is moved through the upper ground layer behind a ploughshare. The seismic signal produced from the detonating cord of the invention at any given explosive charge loading is greater than that produced from a corresponding conventional detonating cord because the thermoplastics sheath of the conventional cord absorbs part of the energy produced by the detonation of the explosive core. If desired the mechanical strength of the cord may be increased by providing additional wrapping materials, for example, one or more additional textile layers.

EXAMPLE

The invention is further illustrated by the following specific Example of the manufacture of a fusecord of the invention.

The explosive core 31 was crystalline PETN (13) of the kind normally used in detonating fusecord loaded at a charge rate of 10 g/m. The tape 16 was glazed Kraft paper 0.08 mm thick and the texile layers 32 and 34 consisted of filaments of 2.5 mm wide 1,000 denier polypropylene tape pin-roller fibrillated with five longitudinal parallel lines of 1 mm long slits with 0.1 mm longitudinal spacing between the slits, the slits in adjacent rows being offset by 0.55 mm. The layer 32 consisted of ten filaments spun at a rate of 26 turns/m and the layer 34 consisted of eight filaments spun at a rate of 39 turns/m of fusecord.

The hot-melt adhesive was a commercial adhesive Flexibond MBX (Registered Trade Mark) available from Borden (UK) Limited, Southampton. It was based on a mixture of ethylene/vinyl acetate copolymer and a rosin ester. This adhesive was sprayed under a compressed air pressure of 30 p.s.i. (2.11 kg/cm$^2$) at 150° C. through two nozzles, each having an orifice of 0.125 mm and the amount of adhesive applied was 0.375 g/m. The diameter of the aperture 22, which determined the external diameter of the finished fusecord, was 4 mm. A conventional detonating cord with the same explosive core loading and textile wrapping has 6.3 g/m of thermoplastics material in the external extruded sheath and the external diameter is 5 mm. The fusecord of this Example is therefore significantly cheaper than conventional fusecord and has significantly less volume and weight per unit length for any given explosive charge loading.

The fusecord of this Example resisted the ingress of water from the side when immersed under 1,000 p.s.i. (70 kg/cm$^2$) hydrostatic pressure for 24 hours which is adequate for most uses. The explosive properties were the same as conventional detonating cord of the same charge loading. The side-to-side detonation propagation distance was 2.5 cm compared to 1.8 cm for conventional detonating cord. This is attributable to the lower volume of inert wrapping material and is indicative of the production of a stronger lateral shockwave which is a significant advantage in using the cord as a seismic wave generator.

What we claim is :

1. An explosive fusecord comprising a core of explosive material surrounded by at least two layers of textile wrapping material, two adjacent wrapping layers being bonded together by an intermediate layer of waterproof hot-melt adhesive material which is a blend of thermoplastic polymeric film-forming material and a tackifying resin.

2. A fusecord as claimed in claim 1 wherein the said wrapping material comprises two layers of filamentary textile material one layer being helically spun around the explosive core and the second layer being helically spun around the first layer.

3. A fusecord as claimed in claim 1 wherein the film forming material is based on polyolefin.

4. A fusecord as claimed in claim 3 wherein the film former comprises a copolymer containing ethylene copolymerised with a comonomer selected from the group consisting of ethylenically unsaturated fatty acids containing from 3 to 8 carbon atoms and ethylenically unsaturated fatty acid esters containing from 3 to 8 carbon atoms.

5. A fusecord as claimed in claim 4 wherein the said comonomer is selected from the group consisting of acrylic acid, methacrylic acid, alkyl esters of acrylic acid and methacrylic acid, hydroxyethyl methacrylate, vinyl acetate and vinyl propionate.

6. A fusecord as claimed in claim 4 wherein the said copolymer contains 7 to 30% by weight of the said comonomer.

7. A fusecord as claimed in claim 1 wherein the resin is selected from the group consisting of coumarone-indene resins, terpene resins, phenolic resins, rosin and rosin derivatives.

8. A fusecord as claimed in claim 7 wherein the resin is selected from the group consisting of hydrogenated rosin and hydrogenated rosin esters.

9. A fusecord as claimed in claim 8 wherein the hydrogenated rosin ester is an ester selected from the group consisting of glycerol and pentaerythritol.

10. A fusecord as claimed in claim 1 wherein the hot-melt adhesive contains petroleum wax.

11. A fusecord as claimed in claim 1 wherein the hot-melt adhesive has an application temperature in the range of 80° to 155° C.

12. A fusecord as claimed in claim 1 wherein the said wrapping material is selected from the group consisting of paper, synthetic plastics, cotton and jute.

13. A fusecord as claimed in claim 12 wherein the wrapping material comprises fibrillated plastics tape.

14. A fusecord as claimed in claim 13 wherein the fibrillated plastics tape comprises fibrillated polypropylene.

15. A fusecord as claimed in claim 1 wherein the core of explosive material is selected from the group consisting of blackpowder and PETN.

16. A fusecord as claimed in claim 1 which is a detonating fusecord having a thin foil envelope immediately around a core of detonating explosive material.

17. A fusecord as in claim 1 wherein said wrapping layers are the two outermost wrapping layers.

18. A method of manufacturing an explosive fusecord which comprises continuously forming a fuse core of explosive material, and surrounding the said core with at least two layers of textile wrapping material which layers are bonded together with a layer of hot-melt adhesive which is a blend of thermoplastic polymeric film-forming material and a tackifying resin.

19. A method as claimed in claim 18 wherein a first layer of filamentary textile material is helically spun around the core, the said first layer is covered with a molten layer of hot-melt adhesive and a second layer of filamentary textile material is helically spun around the layer of molten adhesive, whereby when the adhesive cools the said first and second layers of textile material are bonded together.

20. A method as claimed in claim 18 wherein, when only one of said wrapping layers is in position around the explosive core, molten adhesive is applied to the embryo cord by a method selected from the group consisting of passing the cord through a vessel of molten adhesive, passing the cord over a roll coated with molten adhesive and passing the cord through a spray of molten adhesive.

21. A method as in claim 18 wherein said wrapping layers are the two outermost wrapping layers.

* * * * *